US010807211B2

(12) United States Patent
Montabaur

(10) Patent No.: US 10,807,211 B2
(45) Date of Patent: Oct. 20, 2020

(54) ROTARY TOOL

(71) Applicant: MONTI-Werkzeuge GmbH, Hennef (DE)

(72) Inventor: Alexander Montabaur, Koenigswinter (DE)

(73) Assignee: MONTI-WERKZEUGE GMBH, Hennef (DE)

( * ) Notice: Subject to any disclaimer, the term of this patent is extended or adjusted under 35 U.S.C. 154(b) by 147 days.

(21) Appl. No.: 16/308,966

(22) PCT Filed: Jun. 8, 2017

(86) PCT No.: PCT/EP2017/064035
§ 371 (c)(1),
(2) Date: Dec. 11, 2018

(87) PCT Pub. No.: WO2017/220338
PCT Pub. Date: Dec. 28, 2017

(65) Prior Publication Data

US 2019/0224805 A1 Jul. 25, 2019

(30) Foreign Application Priority Data

Jun. 20, 2016 (DE) ..... 10 2016 111 265

(51) Int. Cl.
*B24B 23/02* (2006.01)
*A46B 13/02* (2006.01)
(Continued)

(52) U.S. Cl.
CPC ..... *B24B 23/022* (2013.01); *A46B 13/001* (2013.01); *A46B 13/02* (2013.01);
(Continued)

(58) Field of Classification Search
CPC ... B24B 23/022; B24B 45/006; B24B 29/005; B24B 17/02; B24B 13/02; B24B 13/001; B24D 13/20
See application file for complete search history.

(56) References Cited

U.S. PATENT DOCUMENTS 5,177,830 A 1/1993 Montabaur
5,386,608 A 2/1995 Montabaur
(Continued)

FOREIGN PATENT DOCUMENTS

DE 102007048480 B 3/2009
EP 0347429 A 1/1996
EP 2371487 A 10/2011

*Primary Examiner* — Weilun Lo
(74) *Attorney, Agent, or Firm* — Andrew Wilford

(57) ABSTRACT

The subject of the present invention is a rotationally drivable rotary tool device and in particular a rotary brush tool. The invention is equipped, in its basic construction, with a tool holder (1, 2) having at least one drive-side clamping element (1) and a tool-side clamping element (2). The two clamping elements (1, 2) are connected releasably together and receive a rotary tool (5, 6). Furthermore, the two clamping elements (1, 2) ensure that the rotary tool (5, 6) is held. According to the invention, the tool-side clamping element (2) and the rotary tool (5, 6) define a structural unit (2, 5, 6). To this end, the clamping element (2) in question is configured as a holding cage (2) that encloses the rotary tool (5, 6) radially and axially at least in part.

10 Claims, 5 Drawing Sheets

(51) Int. Cl.

| | |
|---|---|
| ***A46B 17/02*** | (2006.01) |
| ***B24B 29/00*** | (2006.01) |
| ***B24B 45/00*** | (2006.01) |
| ***B24D 13/20*** | (2006.01) |
| ***A46B 13/00*** | (2006.01) |

(52) U.S. Cl.
CPC ..... *A46B 17/02* (2013.01); *B24B 29/005* (2013.01); *B24B 45/006* (2013.01); *B24D 13/20* (2013.01)

(56) References Cited

U.S. PATENT DOCUMENTS

| | | | | |
|---|---|---|---|---|
| 5,524,315 | A | 6/1996 | Montabaur | |
| 5,637,033 | A * | 6/1997 | Williams | B24B 45/006 411/389 |
| 6,912,755 | B2 | 7/2005 | Chen | |
| 7,192,338 | B2 | 3/2007 | Kausch | |
| 7,901,274 | B2 | 3/2011 | Montabaur | |
| 9,554,642 | B2 | 1/2017 | Montabaur | |
| 2008/0254725 | A1 * | 10/2008 | Henning | B24D 9/08 451/510 |
| 2009/0098813 | A1 * | 4/2009 | Chen | B24D 13/20 451/360 |

* cited by examiner

ROTARY TOOL

CROSS REFERENCE TO RELATED APPLICATIONS

This application is the US-national stage of PCT application PCT/EP2017/064035 filed 8 Jun. 2017 and claiming the priority of German patent application 102016111265.8 itself filed 20 Jun. 2016.

FIELD OF THE INVENTION

The invention relates to drivable rotary tool, particularly a rotary brush tool, comprising a tool holder having at least one drive-mounted part and one tool-mounted part, the two parts being releasably interconnected and receiving and holding a rotary tool.

BACKGROUND OF THE INVENTION

In a rotationally drivable rotary tool having the construction described above and in EP 2 371 487, two specially designed parts are provided and releasably coupled to each other by a closure element against the force of at least one spring. The two parts and the respective tool holder serve to receive the rotary tool. The rotary tool can be a rotary brush with a flexible belt ring such as that described in the applicant's DE 42 05 265 [U.S. Pat. No. 5,386,608], for example, that is also relevant here. In principle, however, a rotary tool according to EP 1 859 903 [U.S. Pat. No. 7,901,274] can also be accommodated by the tool holder.

A comparable rotationally drivable rotary tool is described in DE 100 30 586 [U.S. Pat. No. 7,192,338]. In that document, a tool with a circular disk-shaped tool body is used. The tool body has a central opening for attachment to a machine tool or generally to a rotary drive. A part is provided that engages over the edge of the opening on at least one side of the tool body. A mount is provided on the other side of the tool body that can be clamped onto the machine tool and to which the part can be releasably fastened when the holder is clamped on. As a result, the overall tool body is axially secured and held against rotation. The known tool holder is obviously only usable with circular disk-shaped tool bodies that are designed as cutting or grinding disks.

Rotary brush tools are also known from practice and the literature in a variety of configurations. For instance, DE 43 26 793 [U.S. Pat. No. 5,524,315] concerns a rotationally drivable brush assembly in which the brush holder has two end disks that are spaced apart by a divided spacer bushing and the end disks are set at a predetermined distance from the bushing casing and distributed over the circumference of the disk. The ring brush (annular brush) has a flexible belt ring with outwardly protruding bristles and with bristle-free belt zones for axially extending arms that overlap the belt ring.

In a rotationally drivable tool holder according to EP 0 319 756 [U.S. Pat. No. 5,177,830], two spring washers have concentric annular grooves for semicylindrical sleeves of substantially the same diameter. This is to ensure perfect positioning and stabilization of each clamped tool sleeve while dispensing with a rubber core or other similar support structure.

Finally, the prior art also includes a rotary brush tool as described in EP 0 347 429 that serves as an example for surface treatment. A belt ring holder has a multipart part and an annular body that can be resiliently expanded by the part. The rotary brush tool also has a belt ring with a flat cross section that is a closed ring.

The belt ring holder and the belt ring can form a unit. This renders the tool versatile, effective, and durable at the same time.

The prior art is unable to provide a solution that is satisfactory in all respects. For instance, the brush tool uses a flexible belt in DE 42 05 265 or also in the context of DE 43 26 793. As a result, movements of the belt relative to the tool holder are deliberately utilized for the treatment in some cases, as is described in EP 1 834 733 [U.S. Pat. No. 9,554,642]. In fact, a stop that engages into the rotating cap of bristles of the ring brush is provided here. The stop decelerates the bristles for a certain time, so that, upon their release, the kinetic energy stored in this way is utilized by the bristles for the additionally percussive treatment of a surface of a workpiece. This requires some movement of the flexible belt ring within the tool holder.

When the ring brushes that are used in practice are used in conjunction with the described rotary tools, the ring brush or its belt ring does not "fit" exactly and undergoes more or less uncontrolled movements relative to the tool holder. As a result of this, increased wear is often observed up to and including the destruction of the ring brush during operation. It is in this regard that the invention as a whole aims to provide a remedy.

OBJECT OF THE INVENTION

The object of the invention is to further develop a rotationally drivable rotary tool having the construction described above such that proper operation of the rotary tool in the rotary tool is ensured and, in particular, only defined movements of the rotary tool are permitted.

SUMMARY OF THE INVENTION

To attain this object, a rotationally drivable rotary tool is characterized in the context of the invention in that the tool-mounted part and the rotary tool define a subassembly and the relevant part is to this end a holding cage that encloses the rotary tool radially and axially at least in part.

In the context of the invention, the tool holder is composed, to begin with, of the drive-mounted and the tool-mounted part. The drive-mounted part is generally associated with a drive or a rotary drive. The drive-mounted part is usually connected for this purpose to the rotary drive in question or to a rotationally driven output shaft.

There is also a tool-mounted part that is releasably coupled with the rotary drive via the drive-mounted part. According to the invention, the tool-mounted part and the rotary tool form a subassembly. Uncontrolled movements of the rotary tool that are often observed in the prior art can thus be eliminated from the start by virtue of the design. After all, the rotary tool is connected with the tool-mounted part to the unit.

It is possible for the tool-mounted part and the rotary tool to be mechanically interconnected here, for example by a screw, rivet, or other connection. In general, the tool-mounted part and the rotary tool are welded together (ultrasonically).

The invention assumes in this regard that the tool-mounted part and the rotary tool or, in general, a belt ring are each made of plastic in the case of a rotary brush and can therefore be welded together (ultrasonically). As will readily be understood, an adhesive connection using an adhesive is also possible here as an alternative or in addition and is included.

The tool-mounted part is formed according to the invention as the holding cage that encloses the rotary tool radially and axially at least in part. That is, the rotary tool is fixed both radially and axially in the holding cage in question or can move relative to the holding cage only with radial and axial play that is limited by the holding cage. Collectively defined conditions are thus provided with respect to any movement of the rotary tool relative to the tool holder or, generally, the design of the rotary tool in combination with the tool holder. In this way, the invention ensures that the rotary tool, in conjunction with the subassembly of the rotary tool and the holding cage, always and reproducibly provides the guaranteed characteristics and work results. Herein lie the fundamental advantages.

The holding cage is generally a circular annular cage with peripheral axially extending arms. The axially extending arms engage over the rotary tool. As a rule, the rotary tool has cutouts for this purpose, so that the axially extending arms engage over the rotary tool at these cutouts.

In general, a plurality of axially extending arms are provided on the holding cage that are distributed over the circumference of the holding cage formed as a circular annular cage. For example, three axially extending arms can be used that are distributed angularly around the circular annular cage at a 120° spacing.

Since the holding cage is a circular annular cage and usually has a central bore in which fits the drive-mounted part that is advantageously embodied as an adapter that releasably engages in the holding cage, an inner ring of the circular annular cage surrounds the central bore is thus created.

This inner annular outer surface of the circular annular cage generally receives the belt ring of the ring brush that radially inwardly engages the inner ring in question for this purpose. This can be done with and without play. In general, the belt ring in question and the inner ring are directly adjacent one another. The axially extending arms now define an outer retaining ring, as it were, that is spaced radially outward from the inner ring. In fact, the axially extending arms engage over the rotary tool or the ring brush at the cutouts.

Similarly, the rotary tool or its belt ring is held radially between the inner retaining ring in question and the axially extending arms or the outer retaining ring formed thereby. This is true even if the axially extending arms form only a small portion of the outer retaining ring.

In addition to this radial retention of the rotary tool within the holding cage, the holding cage provides axial retention as well. For this purpose, circumferential radial webs are provided that are interconnected via the axially extending arms. The radial webs thus also axially secure the rotary tool that is received in the interior of the holding cage. The rotary tool is thereby retained radially and axially at least in part because, due to the limited extension of the axially extending arms and radial webs, the holding cage does not provide a continuous, enclosed cage-like enclosure that is also not at all necessary.

As explained previously, the device-mounted part is an adapter that releasably engages in the holding cage. For this purpose, the adapter releasably engages in the central bore of the holding cage. The adapter advantageously has angularly spaced locking pins for this purpose. When the adapter is in the assembled state, the locking pins engage in respective seats in the holding cage.

The locking pins are advantageously radial locking pins, and the seats are generally formed as radial seats. In this case as well, an angularly uniformly distribution of both the locking pins or radial locking pins and the seats or radial seats is recommended. In fact, it is possible in most cases for both the locking pins and the seats to be offset angularly by 120° around the adapter or the central bore. It can be advantageous for the locking pins or radial locking pins and the respective seats or radial seats to each be positioned at the axially extending arms that are likewise arranged with a 120° offset. This makes assembly particularly intuitive.

The locking pins themselves are generally braced against a spring-loaded actuator. For example, it is possible for the actuator when moved against its spring force to allow the locking pins or radial locking pins assume to move into a retracted position. Springs on the locking pins or radial locking pins can also be provided for this purpose.

As soon as the actuator is released and is pushed back in to its rest position by the respective spring, the locking pins are pressed outward against the force of their respective springs and engage into the seats or radial seats. Now the adapter is releasably anchored inside the central bore of the holding cage. On the other hand, in the above-described functional state with the loaded rotary element, the subassembly can be removed from the holding cage and the rotary tool can be removed from the adapter.

In order to facilitate the detachable joining of the adapter and the holding cage by fitting the adapter in the central bore of the holding cage, the adapter and the relevant central bore are generally provided with corresponding centering formations for mutual alignment. As a result, the adapter can be received in the central bore of the holding cage only in certain angular positions. These angular positions correspond to the locking pins or radial locking pins in the adapter being aligned with or also being able to fit in the opposing seats or radial seats in the central bore of the holding cage.

As pointed out previously, the adapter is usually connected to the rotary drive. In most cases, the adapter is connected together with on optional holding plate and one stop to the rotary drive in question. The stop is advantageously one such as has already been described in EP 1 834 733.

The fixed connection of the adapter together with the optional holding plate and the stop to the rotary drive ensures that the position of the stop can be defined and specified relative to the rotary tool to be mounted. After all, the rotary tool forms the above-described subassembly together with the holding cage. Once the subassembly of the rotary tool and the holding cage is coupled with the adapter on the rotary drive, reproducible ratios exist for the length and orientation of the bristles, the possible play of the belt ring of the ring brush or rotary brush against the holding cage, and the position and mounting of the stop. This is of particular importance in order to be able to implement the percussive treatment of the surface of the workpiece or material as described in patent EP 1 834 733 as desired and with verifiable success. Herein lie the fundamental advantages.

BRIEF DESCRIPTION OF THE DRAWING

The invention is explained in further detail below with reference to a schematic drawing that illustrates only one embodiment. In the drawing.

SPECIFIC DESCRIPTION OF THE INVENTION

Figure 1:
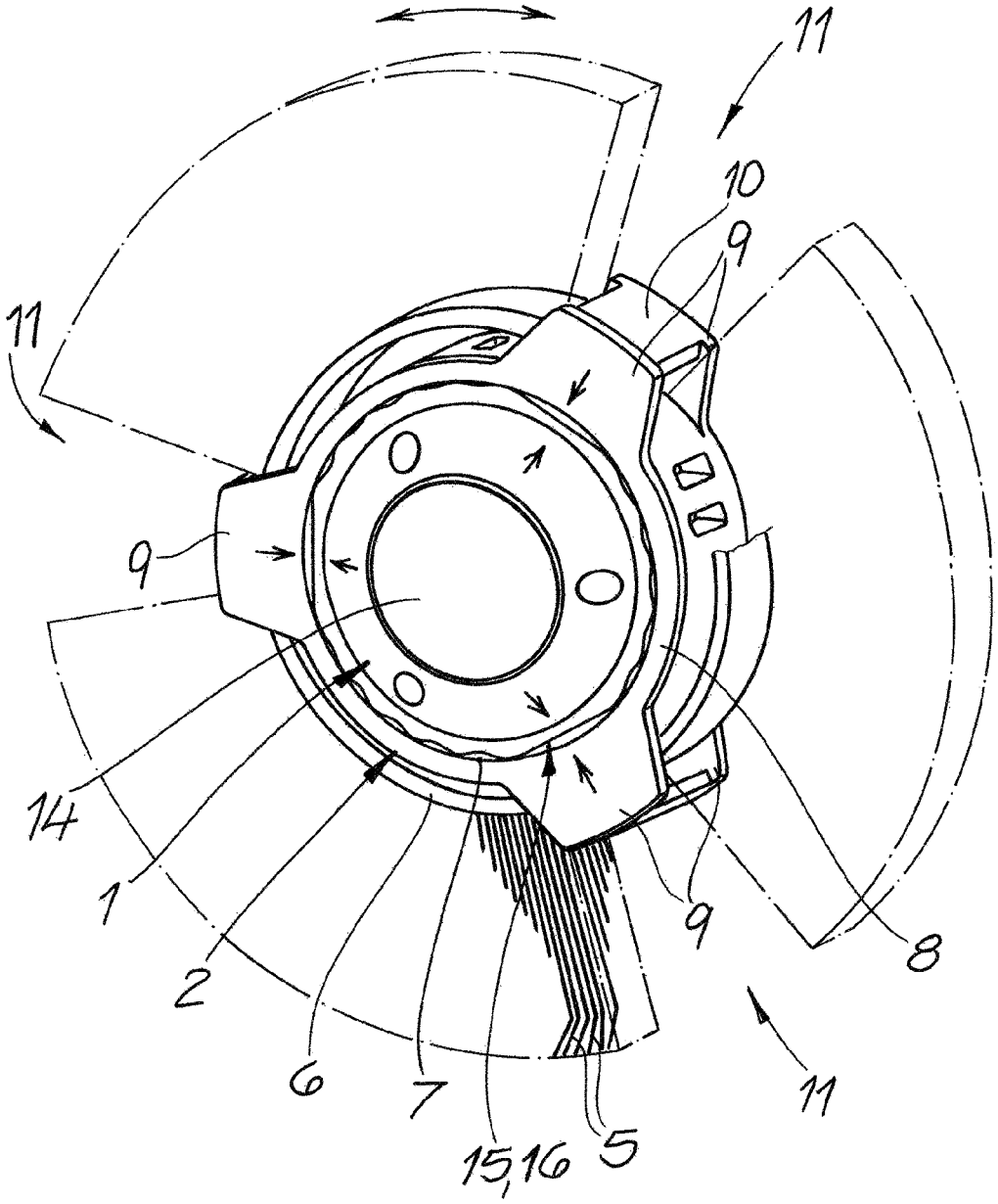
FIG. 1 is a partly cutaway top view of the rotationally driven rotary tool according to the invention.

In the drawings, a rotationally driven rotary tool is shown that in this embodiment and without limitation thereto is a rotary brush or a rotary-brush tool. The basic construction of the tool shown comprises a tool holder 1, 2 equipped with at least one drive-mounted part 1 and a tool-mounted part 2.

In the illustrated embodiment, the drive-mounted part 1 is an adapter 1 that is connected to a rotary drive 3 (shown schematically in FIG. 2) or its drive shaft. A holding plate 4 and a stop S can also be seen in FIG. 2. In the present case, the holding plate 4, the adapter 1, and the stop S are securely connected to the rotary drive 3. Moreover, the design is such that rotation of the output shaft of the rotary drive 3 is transmitted to the adapter 1.

Figure 3:
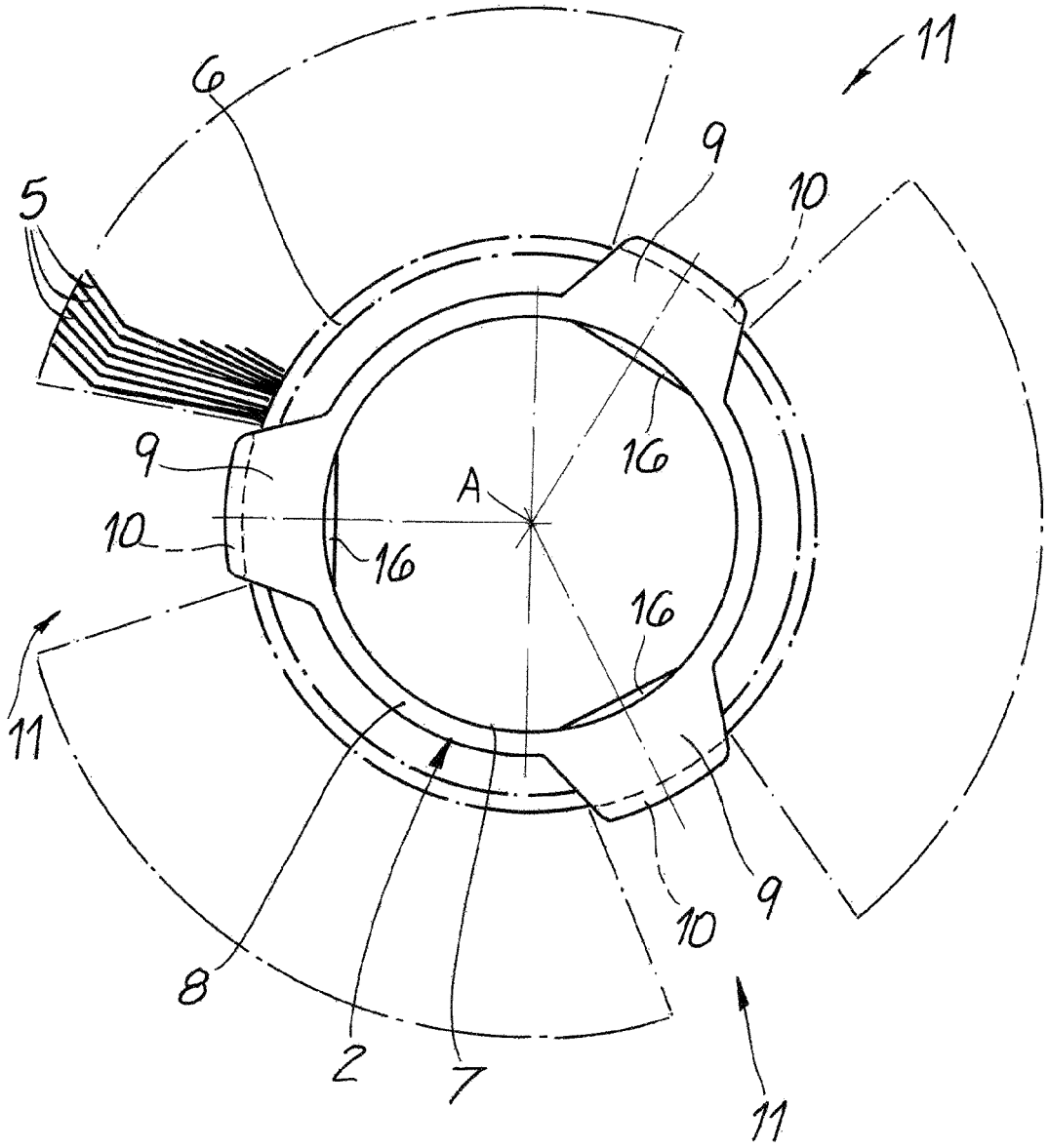
FIG. 3 shows the subassembly of the holding cage and the rotary tool.

The tool-mounted part 2 shown in FIG. 3 is a holding cage 2 that encloses a rotary tool 5, 6 partially radially and axially. As a ring brush or its output shaft 5, 6, the rotary tool 5, 6 is equipped here with an annular belt ring 6 and bristles 5 that are connected to the belt ring 6 and project radially therefrom.

The two parts 1, 2 or the adapter 1 and the holding cage 2 are releasably interconnected and receive and grip the rotary tool 5, 6 in question. By virtue of the releasable connection of the adapter 1 to the holding cage 2, rotation of the output shaft of the rotary drive 3 is transmitted via the adapter 1 to the holding cage 2 and thus to the rotary tool 5, 6 carried along by the holding cage 2 and rotating as a result, as indicated by a double arrow in FIG. 1 for both possible directions of rotation.

As can be seen in FIG. 3, the holding cage 2 is a circular annular cage. Right away, one sees a central bore 7 in the holding cage in question or circular annular cage 2 that is used and designed to receive the adapter 1. A ring or inner retaining ring 8 is also provided that surrounds the central bore 7. Radial webs 9 are connected peripherally to the inner retaining ring 8 so as to be distributed over its circumference. In this embodiment, and without limitation thereto, the radial webs 9 are spaced angularly by 120°.

Two radial webs 9 that are axially opposite one another relative to the central inner retaining ring 8 are interconnected by respective axially extending arms 10 that connect the two radial webs 9 at their outer ends. Again, and without restriction thereto, the axially extending arms 10 are also uniformly angularly spaced 120° apart so as to be distributed over the circumference of the ring or inner retaining ring 8. The axially extending arms 10 define a outer retaining ring that is indicated by dot-dash lines in FIG. 3 and spaced radially outward of the inner retaining ring 8.

The axially extending arms 10 engage over the rotary tool 5, 6. For this purpose, the rotary tool 5, 6 has cutouts 11 in which the axially extending arms 10 are provided and engage over the rotary tool or the ring brush 5, 6.

The axially extending arms 10 and the outer retaining ring and the inner retaining ring 8 now ensure that the rotary tool 5, 6 or its belt ring 6 is secured radially inside the holding cage 2 that is formed in this way and radially enclosed by the holding cage 2. Relative to the central inner retaining ring 8, the radial webs 9 also provide axial support through the holding cage 2 and ensure that the holding cage 2 encloses the rotary tool 5, 6 axially. Since the axially extending arms 10 are provided only partly on the circumference of the inner retaining ring 8 and are spaced apart therefrom, no continuous outer retaining ring is defined by the axially extending arms 10, but rather only a virtual annular surface that is indicated by dashed lines in FIG. 3. Nevertheless, the holding cage 2 formed in this way provides for the desired receiving and holding of the rotary tool 5, 6 and secures it radially and axially.

In principle, the rotary tool 5, 6 can now be received with play within the holding cage 2. According to an advantageous embodiment, however, the rotary tool 5, 6 is mechanically coupled with the holding cage 2. In fact, the rotary tool 5, 6 or the ring brush 5, 6 used here generally has a belt ring 6 made of plastic. The holding cage 2 is also advantageously made of plastic. Different plastics can be used, for example polyamide (PA) for the belt ring 6 and polyethylene (PE) for the holding cage 2. In any case, the holding cage 2 and the belt ring 6 can be welded together (ultrasonically). This is obviously only for the sake of example and not restrictive. The tool-mounted part or the holding cage 2 and the rotary tool or the ring brush 5, 6 thus define a subassembly 2, 5, 6.

Figure 2:
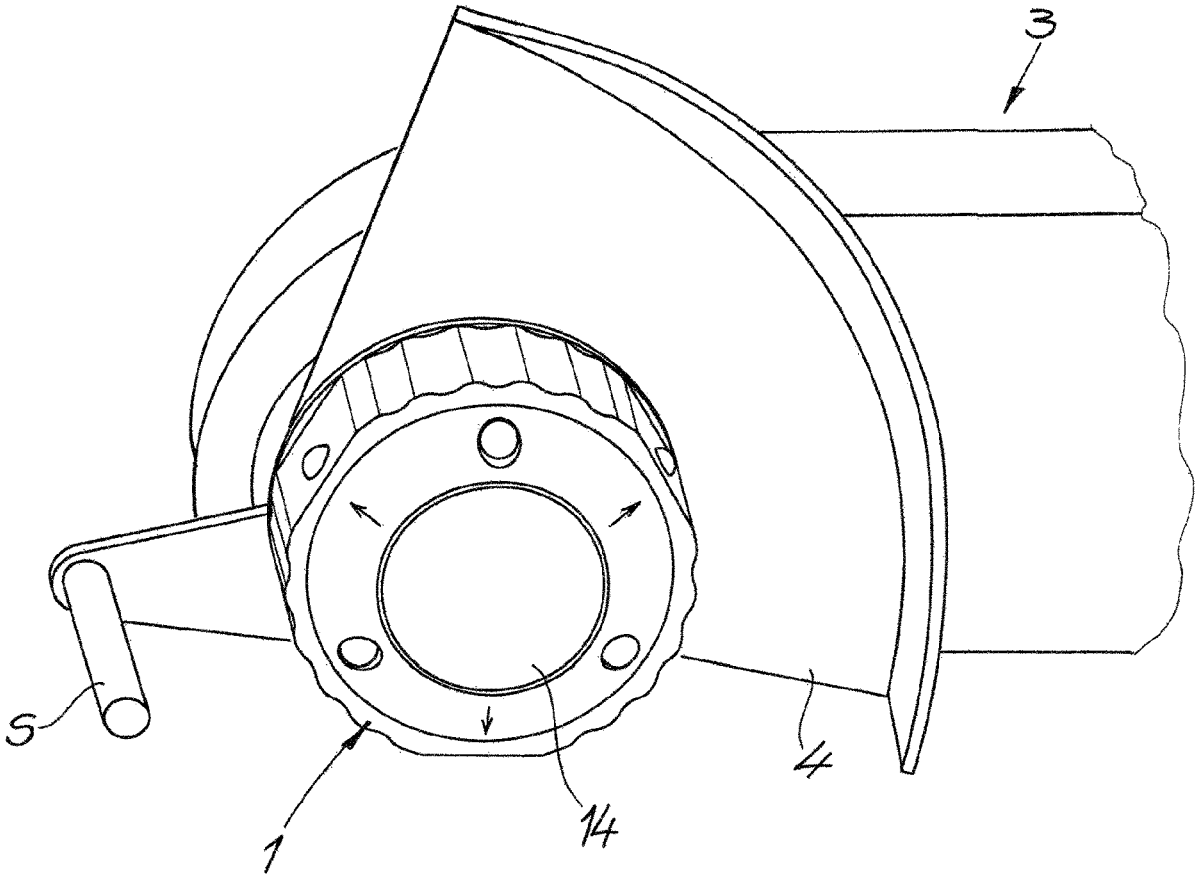
FIG. 2 shows the rotary drive with the adapter, the holding plate, and the stop connected thereto.
Figure 5:
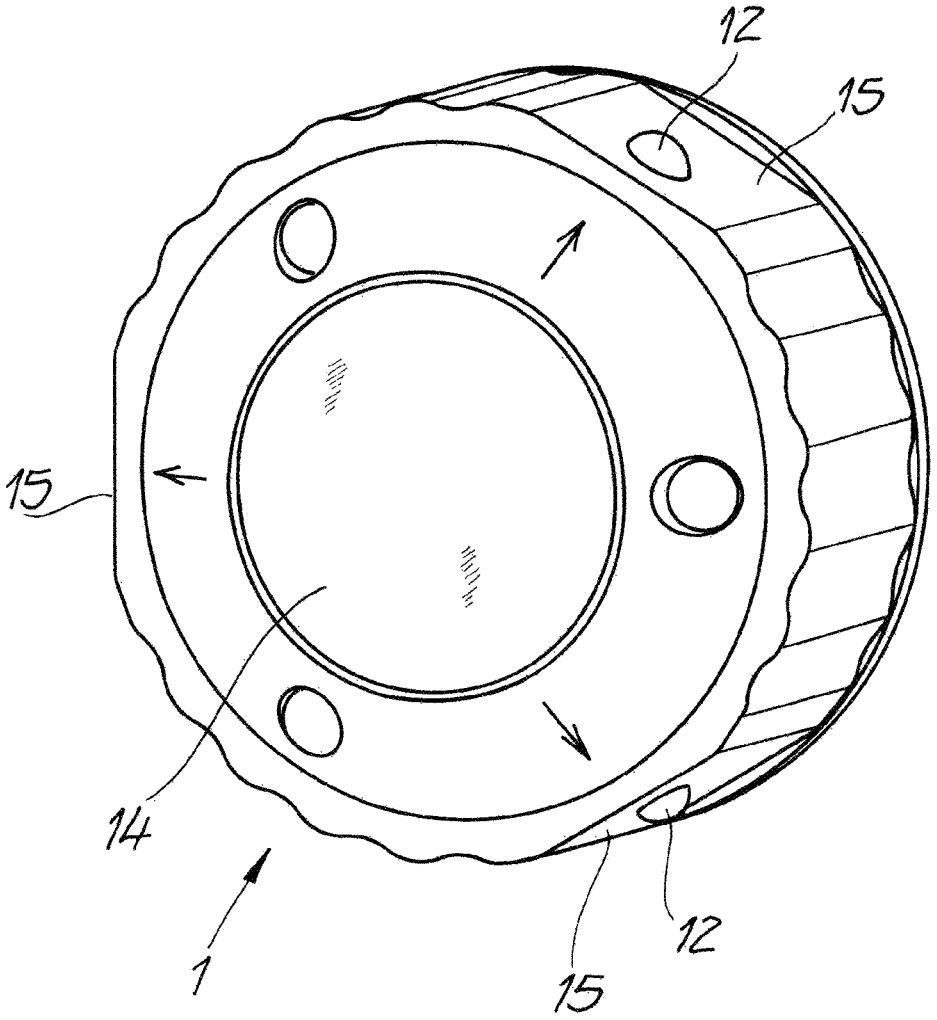
FIG. 5 shows the adapter alone.

In looking at the adapter 1 as in FIGS. 2 and 5, it is immediately apparent that, in the embodiment and without limitation thereto, the adapter 1 is disk-shaped or cylindrical. In fact, the adapter 1 is adapted to the size and shape of the central bore 7 in the holding cage 2. In addition, the adapter 1 has peripheral locking pins 12. When the adapter is in the assembled state, the locking pins 12 engage in respective seats 13 in the holding cage 2.

Figure 4:
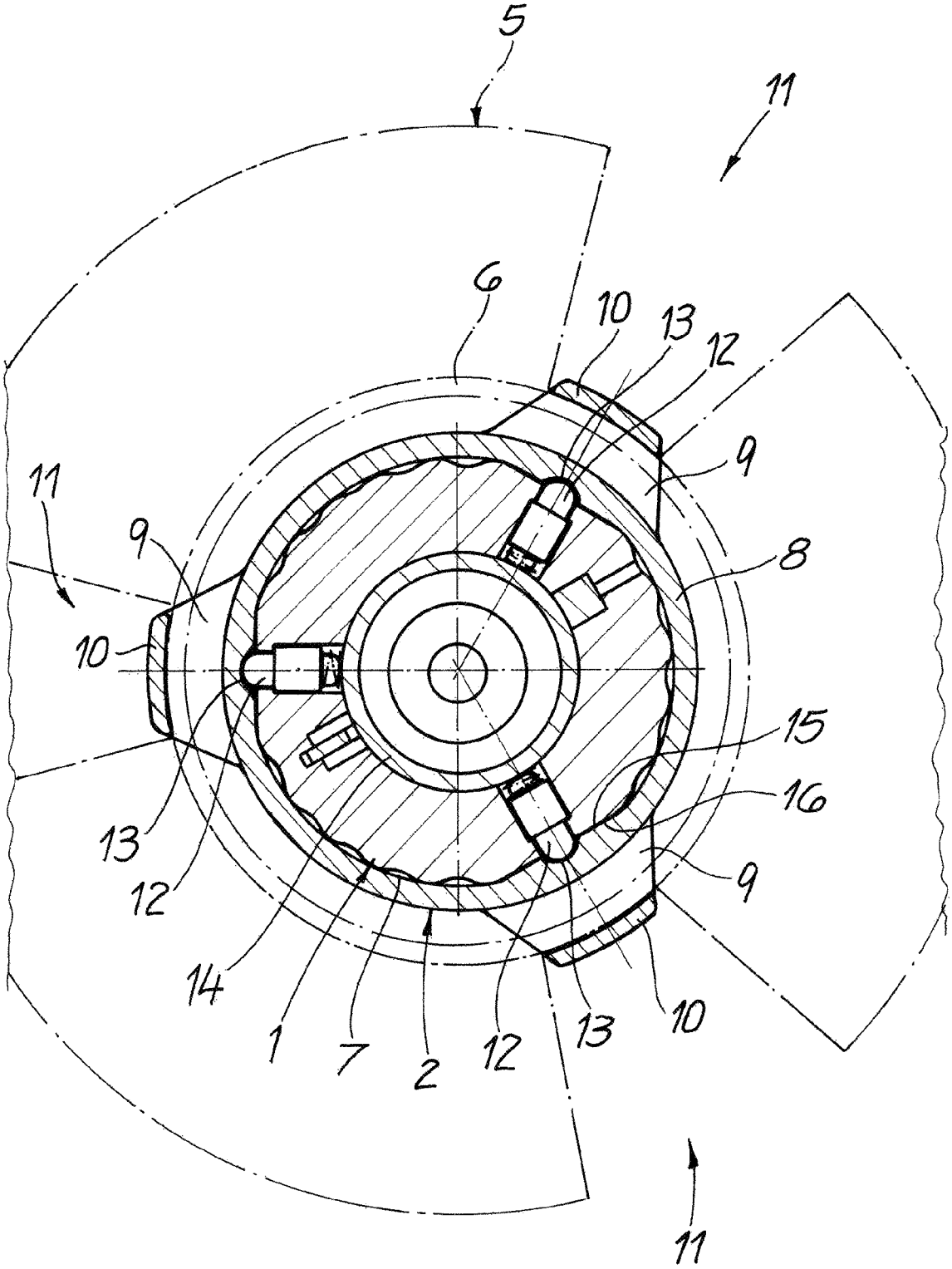
FIG. 4 shows the tool of FIG. 1 with the adapter in section.

As can be seen in FIG. 4, the seats 13 are in fact located in the inner retaining ring 8, specifically at the radial webs 9. In this way, the adapter 1 can be quite intuitively connected in a releasable manner to the holding cage 2.

The locking pins 12 are radial locking pins 12, i.e. locking pins 12 that engage radially in the respective seats 13. It is also for this reason that the seats 13 are formed as radially inwardly open seats 13 in the illustrated embodiment. The locking pins 12 are now braced by respective springs against an actuator 14.

In the embodiment, the actuator 14 is a central knob 14 of the adapter 1. When actuated, the actuator 14 and spring biasing retract the locking pins 12 radially into the adapter, so that, in this depressed position of the actuator knob 14, the subassembly 2, 5, 6 can be pulled without any difficulty for removal of the holding cage 2 and the rotary tool 5, 6 from the adapter 1 that is connected to the rotary drive 3. What is more, this enables differently designed rotary tools 5, 6, including a holding cage 2, to each be securely anchored as a subassembly 2, 5, 6 on the adapter 1 connected to the rotary drive 3.

Once the actuating knob or the actuator 14 is released, its spring moves the actuator 14 so that the locking pins 12 are forced outward into their extended position. In this extended position, the locking pins 12 can engage in the seats 13 and anchor the subassembly 2, 5, 6 of the holding cage 2 and the rotary tool 5, 6 in a torque-transmitting manner on the adapter 1. When the adapter 1 is rotated by the drive 3, the rotary tool 5, 6 is also rotated.

Also visible are corresponding centering formations 15, 16 on the adapter 1 on the one hand and on the other hand on the inner retaining ring 8 around the central bore 7. The centering formations 15, 16 are flats that ensure that the otherwise circular-section adapter 1 can engage in a torque-transmitting and centered manner in the central bore 7 that is otherwise also circular in cross section. This ensures that the holding cage 2 with the rotary tool 5, 6 mounted therein can be rotationally fixed on the adapter 1 and, consequently, rotation of the rotary drive 3 or its output shaft is transmitted properly to the rotary tool 5, 6.

The invention claimed is:

1. A rotationally drivable tool comprising:

a rotary brush tool rotatable about an axis; and a tool holder having a drive-mounted part having peripheral locking pins and a tool-mounted part having seats, the two parts being releasably interconnected to hold the rotary brush tool in an assembled state with the pins engaged in the seats, the tool-mounted part and the rotary tool forming a subassembly, the tool-mounted part being to this end a holding cage that at least partially encloses the rotary tool radially and axially.

2. The tool according to claim 1, wherein the drive-mounted part is an adapter that engages releasably in the holding cage.

3. The tool according to claim 2, wherein the holding cage is circular and has peripheral axially extending arms that engage over the rotary tool.

4. The tool according to claim 3, wherein the axially extending arms engage over the rotary tool at cutouts thereof.

5. The tool according to claim 1, wherein the holding cage has a central bore in which the drive-mounted part fits.

6. The tool according to claim 1, wherein the locking pins are formed as radially extending locking pins and the respective seats are formed as radially open seats.

7. The tool according to claim 1, wherein the locking pins are braced by springs against an actuator.

8. The tool according to claim 1, wherein the drive-mounted part and a central bore in the holding cage have respective centering formations for mutual alignment and torque-proof coupling in order to hold the drive-mounted part.

9. The tool according to claim 1, wherein the drive-mounted part is connected together with a holding plate and one stop to a rotary drive.

10. In combination:

a drive having an output rotatable about an axis;

a brush tool having a ring and a multiplicity of bristles projecting radially outward from the brush except at a plurality of cutouts generally angularly equispaced cutouts;

an adapter mountable on the drive output for rotation therewith and having an outer surface;

a cage having an inner ring complementarily fittable around the adapter and fittable within the ring of the brush tool and an outer ring formed by a plurality of axially extending arms each fittable in a respective one of the cutouts when the brush ring is between the inner and outer rings; and latch means including radially outwardly extendable pins on the adapter on the adapter and radially inwardly open seats on the cage for releasably securing the cage and brush tool on the adapter.

* * * * *